US005574955A

United States Patent [19]

Strömgren et al.

[11] Patent Number: 5,574,955

[45] Date of Patent: Nov. 12, 1996

[54] METHOD AND DEVICE FOR HEATING POWDER, AND THE USE OF SUCH A DEVICE

[75] Inventors: Mats Strömgren, Mölle; Michael Johansson, Höganäs, both of Sweden

[73] Assignee: Hoganas AB, Hoganas, Sweden

[21] Appl. No.: 419,987

[22] Filed: Apr. 11, 1995

[30] Foreign Application Priority Data

Apr. 13, 1994 [SE] Sweden ..... 9401239

[51] Int. Cl.[6] ..... B22F 1/00

[52] U.S. Cl. ..... 419/30; 419/54; 419/31; 148/513

[58] Field of Search ..... 419/30, 31, 54; 425/264, 378.1; 366/146; 148/513

[56] References Cited

U.S. PATENT DOCUMENTS

| | | | |
|---|---|---|---|
| 3,738,794 | 6/1973 | Thelen | 432/14 |
| 4,209,320 | 6/1980 | Kajinaga et al. | 75/0.5 BA |
| 4,223,874 | 9/1980 | Kajinaga et al. | 266/129 |
| 4,725,227 | 2/1988 | Hailey | 432/239 |
| 4,874,312 | 10/1989 | Hailey | 432/122 |
| 4,913,641 | 4/1990 | Zahradnik | 425/204 |

FOREIGN PATENT DOCUMENTS

| | | |
|---|---|---|
| 0516467 | 12/1992 | European Pat. Off. . |
| 2430972 | 1/1975 | Germany . |
| 2824140 | 1/1979 | Germany . |
| 3131425 | 1/1982 | Germany . |
| 758661 | 8/1982 | Russian Federation . |
| 334022 | 5/1971 | Sweden . |

*Primary Examiner*—Charles T. Jordan
*Assistant Examiner*—Daniel Jenkins
*Attorney, Agent, or Firm*—Burns, Doane, Swecker & Mathis, L.L.P.

[57] ABSTRACT

A method and a device for heating powder, especially for preheating powder in view of subsequent compacting, are disclosed. The powder is divided into partial flows which are heated separately to a predetermined temperature. Then, the partial flows are brought together to form a common flow of heated powder. The partial flows are so heated that an uniform temperature is attained over essentially the entire cross-section of each of the partial flows before these are brought together. The device comprises a storage container (10) for the powder, and a heating unit (20) for receiving powder from the storage container (10) and heating it. The heating unit (20) comprises a plurality of spaced-apart heating surfaces (27) defining between them a plurality of flow channels (28) for the powder.

21 Claims, 5 Drawing Sheets

METHOD AND DEVICE FOR HEATING POWDER, AND THE USE OF SUCH A DEVICE

This invention relates to a method for heating powder, especially for preheating metal powder in view of subsequent compacting thereof, as well as a device for implementing the method. In addition, the invention concerns the use of the inventive device for preheating metal powder in view of subsequent compacting thereof.

The invention is especially, albeit not exclusively, suited for preheating substantially loose or non-packed metal powder, which then is supplied to a mould where it is compacted into a powder compact. Thus, the following description of the underlying complex of problems and of the use of the invention focuses on such preheating. However, it should be emphasised that the invention is generally applicable to the heating of other types of powders and may serve other purposes than to preheat a powder in view of subsequent compacting.

In metallurgical powder compacting, it is well-known to compact metal powder and then heat the resulting compacts in order to remove any lubricant present in the powder as well as sinter the compacts and thus make them stronger. To this end, use is conventionally made of radiant-heat furnaces, giving a satisfactory heating result owing to the powder being densely packed together and thus having a high thermal conductivity.

Within this field, it is further known, e.g. from EP-A2-0 516 467, to preheat the powder before compacting, which can be brought about by heating the not-yet-filled mould and/or preheating the powder before it is supplied to the mould. The present invention specifically aims at solving the problems associated with such preheating of the powder before it is supplied to a mould where it is compacted.

The powder can be heated in many, slightly different ways, depending on the type of powder to be heated and the purpose of the heating operation.

When heating substantially loose or non-packed metal powder, there is the problem of the powder acting as an insulating material, since it consists of particles having a relatively small total contact surface with each other, so that the powder is porous and contains a considerable amount of air. For instance, a loose or non-packed powder may have a density which is but a third of that of a solid densely-packed compact, i.e. it contains two thirds of air in the voids between the particles. As a result, the heat transfer between the particles is rendered more difficult. Thus, a non-packed powder has a comparatively low thermal conductivity compared with a powder compact.

When preheating metal powder in view of a subsequent compacting step, it is important that the powder attains a uniform temperature before being compacted, since a non-uniform temperature results in the compact obtaining a non-uniform density.

Furthermore, it is of importance that the powder is not overheated when preheated, since this may cause the powder to oxidise, giving an inhomogeneous powder and a powder compact of non-uniform density.

Moreover, the heating equipment must not be too complicated or too bulky, but should be easily combined with existing compacting equipment.

A prior-art method for preheating metal powder in view of a subsequent compacting step is described in EP-A2-0 516 467, mentioned above. The EP specification discloses a system, intended for a compacting press, for preheating and feeding polymer-coated powder. The powder is heated while being fed in a horizontal feeding screw equipped with spiral heating elements disposed on the outside of and along a housing enclosing the feeding screw. This system is complicated in its design and has many movable components, involving the risk of operational disturbance, and in addition requires energy for rotating the feeding screw.

A basic object of the invention is to provide a simple and reliable method for heating powder so that it attains a uniform temperature, especially for uniformly preheating metal powder to be compacted.

Furhermore, a special object of the invention is to prevent the powder from being overheated.

These and other objects are achieved by temporarily dividing the powder into partial flows which are heated separately to a predetermined temperature. Then, the partial flows are brought together to form a common outflow of heated powder. The partial flows are heated in such a manner that a uniform temperature is attained over essentially the entire cross-section of each of the partial flows before these are brought together.

Thus, the present invention provides a method for heating powder, especially for preheating metal powder in view of subsequent compacting thereof, said method being characterised in that the powder is temporarily divided into a number of separate partial flows which are urged on by gravity and each have an inlet and an outlet and which are heated separately to one and the same predetermined outlet temperature and then are brought together to form a common outflow of heated powder, the partial flows being so heated that the predetermined outlet temperature is attained over essentially the entire cross-section of each of the partial flows before these are brought together.

The invention further provides a device for heating powder, especially for preheating metal powder in view of subsequent compacting thereof, said device comprising in a manner known per se a storage container for the powder, and a heating unit for receiving powder from the storage container and heating it, said device being characterised in that the heating unit comprises a plurality of spaced-apart heating surfaces defining between them a plurality of flow channels each having an upper inlet opening for receiving powder from the storage container and a lower outlet opening for discharging a partial flow of heated powder, and a means for bringing together the partial flows to form a common outflow of heated powder.

The invention also concerns the use of a device according to the invention for preheating metal powder, wherein the preheated powder in the common outflow is passed to a mould where it is compacted.

A novel and distinctive feature of the invention is that the powder is divided into a number of separate partial flows, which enables rapid and uniform heating of all the particles in the powder, since the heat supplied need not be conducted through a large quantity of powder of low thermal conductivity. The expression "separate partial flows" used herein is meant to encompass also essentially separate partial flows which to some extent are in contact with one another.

Another distinctive feature of the invention is that all the partial flows are uniformly and separately heated to a common predetermined temperature before being brought together. This is an important feature, since no substantial equalisation of the temperature in the common outflow can be relied upon if the partial flows have been non-uniformly heated, owing to the low thermal conductivity of the powder.

Further distinctive features and advantages of the invention will appear from the following description and the appended claims.

An exemplifying embodiment of the invention will now be described in more detail with reference to the accompanying drawings, in which FIG. 1 is a schematic view of a preferred embodiment of an inventive device combined with compacting equipment;

Figure 1:
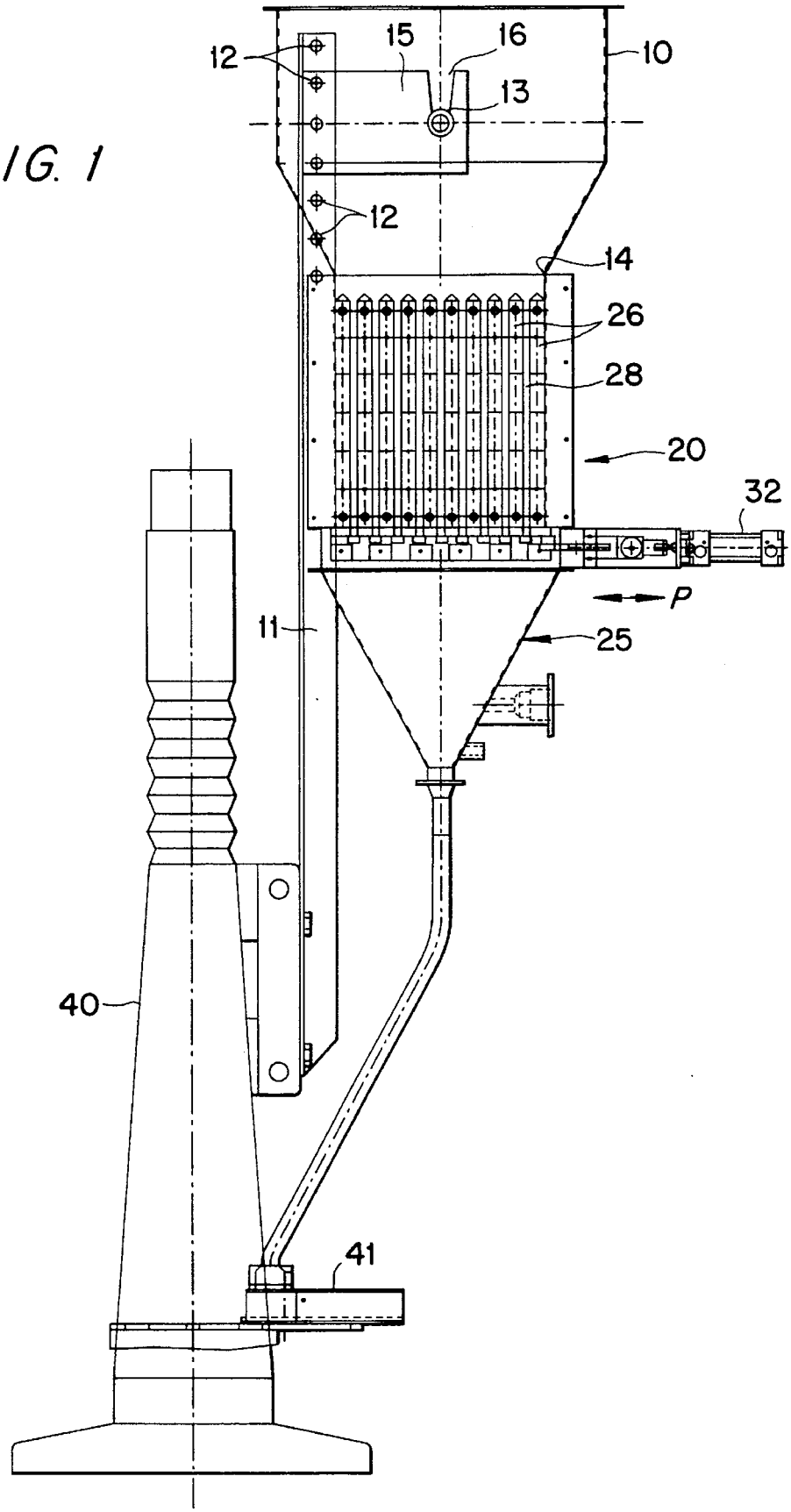

The device illustrated in FIGS. 1 and 2 comprises a powder storage container 10 and a heating unit 20 located below the storage container 10 for receiving metal powder therefrom and heating it. Further, FIG. 1 schematically illustrates a compacting device 40 (not described in detail) connected to the heating unit 20.

The storage container 10 is suspended from a frame 11 which, on opposite sides of the container, has a number of vertically distributed levelling pins 12 or the like, which support a vertically displaceable bracket 15 provided with an upwardly open groove 16, and are adapted for receiving suspension shafts 13 projecting sideways from the outside of the container 10. At the bottom, the storage container 10 opens into a funnel-shaped outlet opening 14.

The heating unit 20, which is located straight below the outlet opening 14 of the storage container 10, comprises a vertically extending casing 21 which is open at the ends and which, at its upper end 22, receives and encloses the outlet opening 14 of the storage container 10, and, at its lower end 23, is connected to an outlet means 25 via a valve means 24, to be described in more detail below.

Inside the casing 21, there are mounted a plurality of spaced-apart fluid-heating elements 26 extending vertically along essentially the entire height of the cover 21. It should be emphasised that the number of heating elements 26 may, in actual practice, differ quite considerably from that of the merely schematically illustrated example. The heating elements 26 essentially have the shape of parallel, platelike wall elements. The surfaces of the heating elements 26 facing one another form heating surfaces 27 defining between them a plurality of vertical, platelike and plane-parallel flow channels 28.

Conveniently, the heating surfaces 27 are spaced apart by 1–30 mm, preferably by 5–20 mm, depending, inter alia, on the powder material, the flow velocities and the heating temperature.

Each flow channel 28 has an upper inlet opening 28*a* for receiving metal powder from the storage container 10, as well as a lower outlet opening 28*b* for discharging partial flows of heated powder to the outlet means 25. The upper horizontal edges 26*c* of the heating elements 26 are ridge-shaped in order to guide the powder from the storage container 10 down into the respective flow channels 28.

Figure 2:
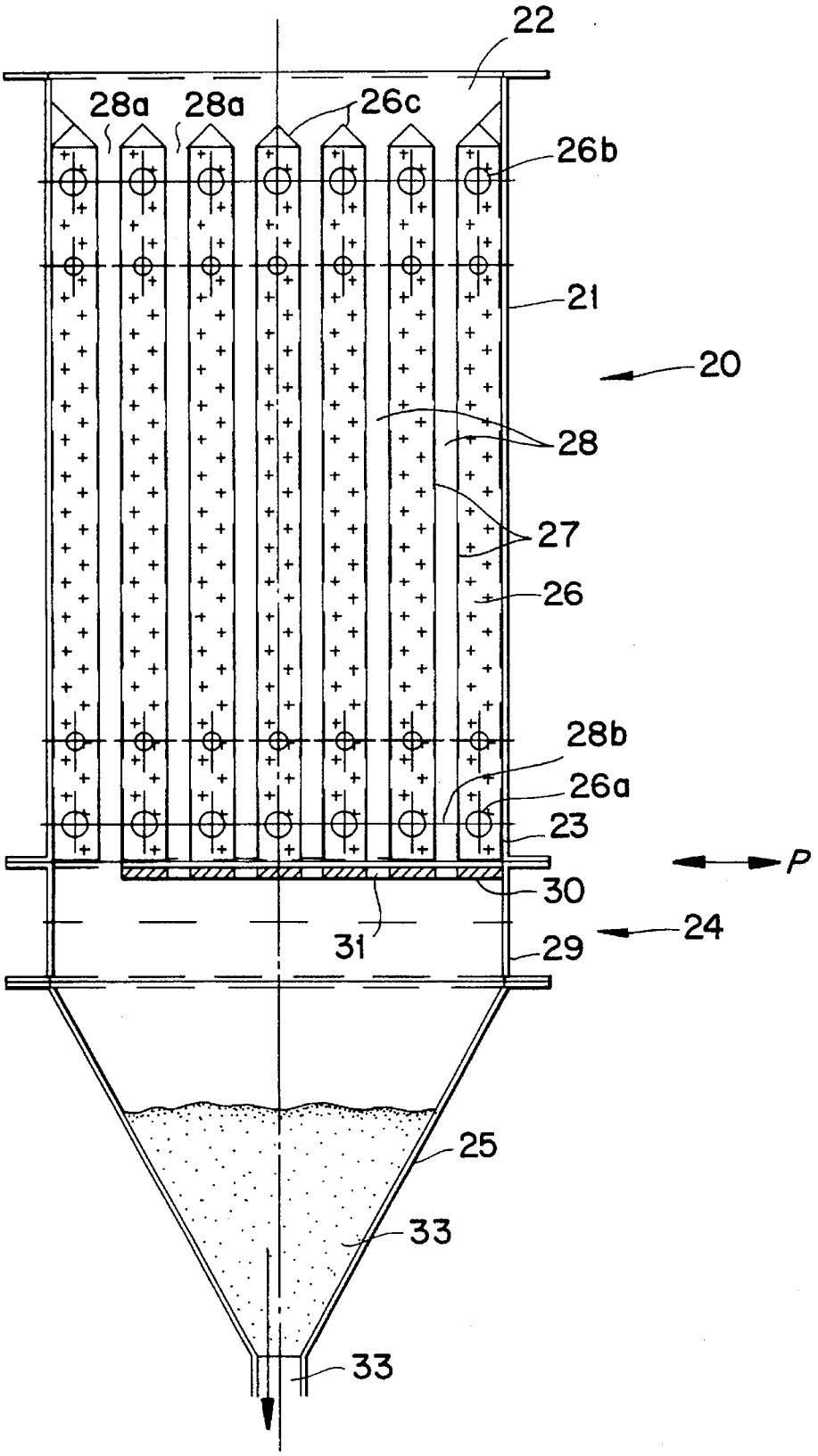
FIG. 2 is a large-scale view of the heating unit in FIG. 1.

In the inventive embodiment illustrated in FIGS. 1 and 2, the surfaces 27 are heated by means of a fluid, such as oil, which in heated state is conducted to the heating unit 20 and supplied through the inlet 26a of each heating element 26, so as to flow along internal flow paths (not shown) of the heating elements 26 and then be discharged through outlets 26*b*. The inlets 26*a* and the outlets 26*b* may change places, as compared with the embodiment in FIG. 2.

The valve means 24, which controls the flow velocity of the partial flows in the channels 28, comprises a casing 29 which at the top is connected to the casing 21 and at the bottom is connected to the outlet means 25, as well as a valve member 30 extending over essentially the entire cross-section of the casing 29. The valve member 30 has a number of separate flow-through openings 31, equal in number to the outlet openings 28*b*, and is reciprocable in the direction indicated by the double arrow P transversely of the partial flows for simultaneous control thereof. Furthermore, FIG. 1 schematically illustrates a piston and cylinder assembly 32 adapted to displace the valve member 30 in the lateral direction.

Heat can be supplied to the heating surfaces 27 also in other ways. For instance, the heating unit may comprise electric resistor heater elements which are separate from the flow channels 28 and arranged adjacent to and distributed over the heating surfaces 27.

Moreover, the electric resistor heater elements can be so arranged that the heating surfaces 27 are divided into a plurality of zones having different power supply, as seen in the direction of flow. Such resistor heater elements may consist of separate electric heaters or of a foil extending over the entire heating surface.

The device described above operates as follows. Under the action of gravity, the powder in the storage container 10 flows down through the upper inlet openings 28*a* of the heating unit 20, to be divided into a number of vertical partial flows (not shown) urged on by gravity. The partial flows, which completely fill up the flow channels 28, are heated separately to one and the same predetermined temperature $T_{out}$ in the flow channels 28 as a result of the contact with the heating surfaces 27, the power supply from the heating surfaces 27 and the valve means 24 controlling the temperature to which the powder is heated.

When the powder has attained the predetermined temperature $T_{out}$, the heated partial flows are brought together to form a common outflow 33 by means of the funnel-shaped outlet means 25. The valve means 24 ensures that the heated powder in the outlet means 25 does not cause any non-uniform deceleration of the partial flows. Owing to the valve means 24, all the partial flows have the same flow velocity. Without the valve means 24, the central partial flows would, in the embodiment illustrated, flow faster than the peripheral partial flows, resulting in non-uniform heating.

As mentioned in the foregoing, it is of importance that the powder is so heated that the same temperature $T_{out}$ is attained over essentially the entire cross-section of each of the partial flows before these are brought together, since no substantial heat transfer or temperature equalisation takes place after the partial flows have been brought together to form a common outflow 33.

Furthermore, it is essential that the powder is not overheated, since it may then oxidise and obtain a non-uniform density, which in turn may result in an inhomogeneous powder compact. In order to prevent overheating, the temperature of the heating surfaces 27 can be controlled in various ways, and the surface temperatures chosen may also vary. Preferably, the surface temperature at the outlet openings 28*b* should never exceed the predetermined outlet temperature $T_{out}$ of the powder. It is thus ensured that the powder is not overheated, even if an operational disturbance of the plant were to cause a temporary standstill of the partial flows in the heating unit 20. Under optimum conditions, the surface temperature at the outlet openings 28*b* is approximately equal to the predetermined outlet temperature $T_{out}$ of the powder.

The surface temperature of the heating surfaces 27 at the inlet openings 28*a* of the flow channels 28 can be so controlled as to either exceed or be below the predetermined temperature $T_{ut}$. The alternative chosen largely depends on the powder used and the permitted residence time in the flow channels 28.

After the powder has been preheated as above, the heated common outflow 33 is conducted, via a reciprocable press shoe 41, to a mould which forms part of the compacting device and where the powder is compacted.

The heated powder may consist of different sorts of powders and usually is substantially made up of metal-base powders, preferably iron powder.

The predetermined outlet temperature of the powder largely depends on the type of powder used. In the case of iron powder, this temperature is in the range of 50°–250°.

The flow channels 28 for the powder may further consist of tubes having a square or circular profile and may, as seen from above, have a spiral or folded-leaf shape. Alternatively, the flow channels 28 may be designed as concentric, annular compartments.

Figure 3:
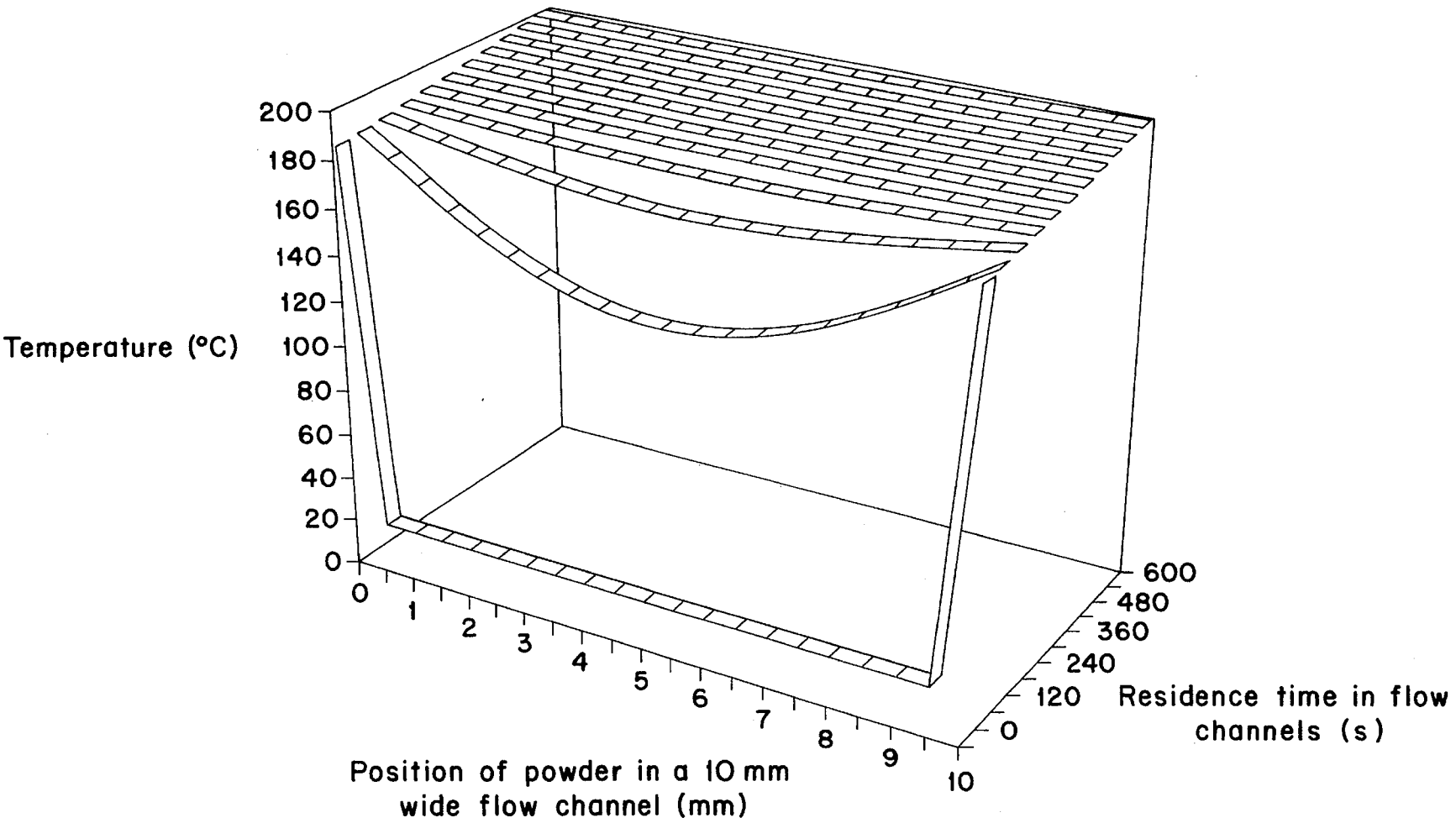
FIG. 3 shows a computer-simulated powder-temperature profile for the heating unit in FIGS. 1 and 2.
Figure 4:
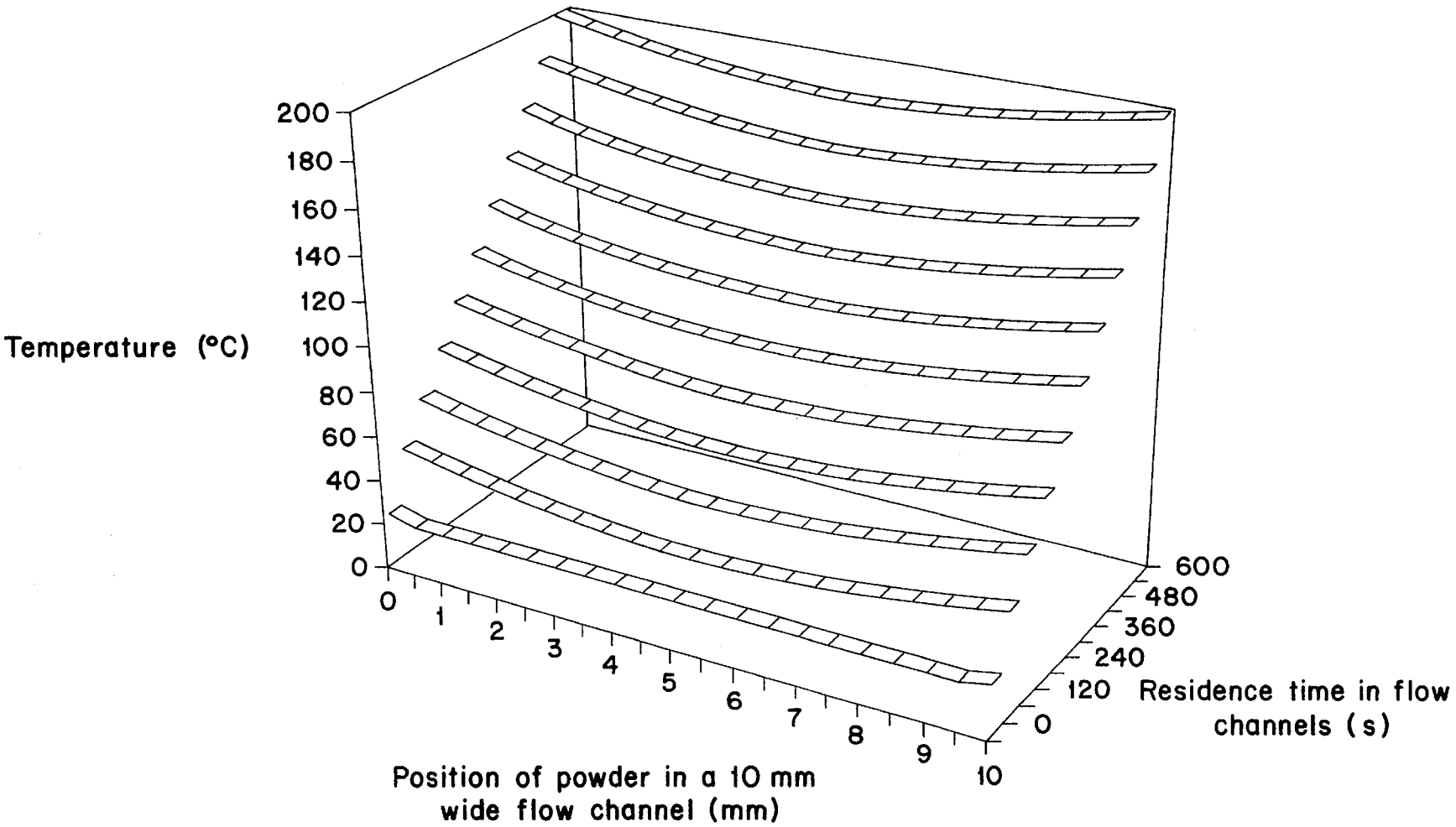
FIG. 4 shows a computer-simulated temperature profile for another embodiment of the heating unit.
Figure 5:
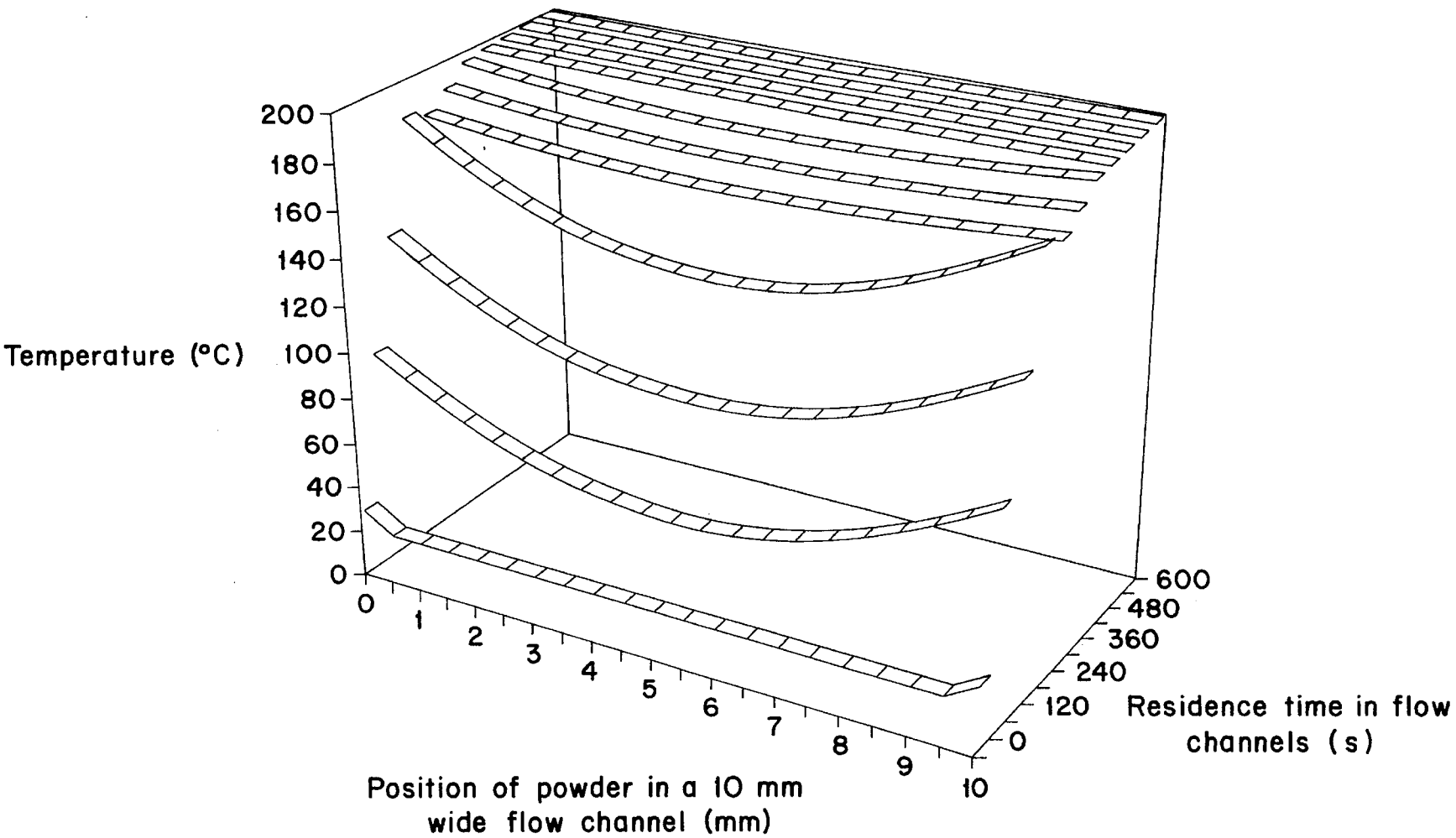
FIG. 5 shows a computer-simulated temperature profile for a heating unit comprising three heating zones.

In order to illustrate the powder-temperature profile of different heating units according to the invention, computer simulations have been performed, and the results of three such simulations are shown in FIGS. 3–5. In the three-dimensional diagrams of FIGS. 3–5, the coordinate directions relate to, respectively, powder temperature, residence time in the flow channels, and powder position in a 10-mm-broad flow channel.

FIG. 3 illustrates a simulated heat supply to the heating surfaces 27 by means of a heated fluid in the form of oil having a temperature of about 200° C. It appears from the diagram that the powder in direct contact with the heating surfaces was heated comparatively rapidly to the predetermined temperature $T_{out}$ (200° C.). Then, the temperature profile transversely of the flow channel levelled away so that all the powder particles attained the predetermined outlet temperature $T_{out}$ during the residence time in the flow channel.

In the computer simulation illustrated in FIG. 4, heat was instead supplied by means of electric resistor heater elements, the same power being supplied to all the heating surfaces. It appears from the Figure that the powder was heated substantially uniformly in the cross-section during the entire heating procedure, and that the powder in the beginning had a strong cooling effect on the heating surfaces before the temperature in the powder began to rise.

In the computer simulation illustrated in FIG. 5, heat was also supplied by means of electric resistor heater elements, but the heating surfaces were here divided into three zones having different power supply, as seen in the direction of flow. The power supply was the highest at the inlet openings of the flow channels, to decrease stepwise in the two subsequent zones towards the outlet openings of the flow channels. Thus, the heating effect was stronger at the beginning, and the powder reached the predetermined outlet temperature $T_{out}$ more rapidly. The power supply at the outlet openings corresponded to a heating effect giving exactly the predetermined outlet temperature. However, the power supply at the inlet openings corresponding to a heating effect giving a higher temperature than the predetermined outlet temperature $T_{out}$.

The present invention has the advantage of enabling reliable production of an uniformly heated powder. In addition, there is no risk of the powder being overheated, which in the case of iron powder might lead to undesirable oxidation.

We claim:

1. A method for heating powder, especially for preheating metal powder in view of subsequent compacting thereof, characterised in that the powder is temporarily divided into a number of essentially separate partial flows which are urged on by gravity and each have an inlet and an outlet and which are heated separately to one and the same predetermined outlet temperature ($T_{out}$) and then are brought together to form a common outflow (33) of heated powder, the partial flows being so heated that the predetermined outlet temperature ($T_{out}$) is attained over essentially the entire cross-section of each of the partial flows before these are brought together.

2. A method as set forth in claim 1, characterised in that the partial flows are heated by contacting the powder with heating surfaces (27) which define the partial flows and whose surface temperature at the outlets (**28*b***) of the partial flows is so controlled as not to exceed the predetermined outlet temperature ($T_{ut}$).

3. A method as set forth in claim 2, characterised in that the surface temperature of the heating surfaces (27) at the inlets (**28*a***) of the partial flows is so controlled as to exceed the predetermined outlet temperature ($T_{out}$).

4. A method as set forth in claim 2, characterised in that the surface temperature of the heating surfaces (27) at the inlets (**28*a***) of the partial flows is so controlled as to fall below the predetermined outlet temperature ($T_{out}$).

5. A method as set forth in claim 2, characterised in that the heating surfaces (27) are divided into a plurality of zones succeeding one another in the flow direction of the partial flows and having different power supply for heating the partial flows.

6. A method as set forth in claim 1, characterised in that the surface temperature of the heating surfaces (27) at the outlets (**28*b***) of the partial flows is so controlled as to be approximately equal to the predetermined outlet temperature ($T_{out}$).

7. A method as set forth in claim 6, characterised in that the surface temperature of the heating surfaces (27) at the inlets (**28*a***) of the partial flows is so controlled as to exceed the predetermined outlet temperature $T_{out}$).

8. A method as set forth in claim 6, characterised in that the surface temperature of the heating surfaces (27) at the inlets (**28*a***) of the partial flows is so controlled as to fall below the predetermined outlet temperature ($T_{out}$).

9. A method as set forth in claim 6, characterized in that the heating surfaces (27) are divided into a plurality of zones succeeding one another in the flow direction of the partial flows and having different power supply for heating the partial flows.

10. A method as set forth in claim 1, characterised in in that the heated powder in the outflow (33) is passed to a mould where it is compacted.

11. A method as set forth in claim 1, characterised in that the predetermined outlet temperature is in the range of 50°–250° C.

12. A method as set forth in claim 1, characterised in that the powder includes metal powder, preferably iron powder.

13. A device for heating metal powder, said device comprising a storage container (10) for the powder, and a heating unit (20) for receiving powder from the storage container (10) and heating it, characterised in that the heating unit (20) comprises a plurality of spaced-apart heating surfaces (27) defining between them a plurality of flow channels (28), each having an upper inlet opening (**28*a*) for receiving powder from the storage container (10) and a lower outlet opening (28*b*) for discharging a partial flow of heated powder, and a means (25) for bringing together the partial flows of heated powder to form a common outflow (33**).

14. A device as set forth in claim 13, characterised in that a valve means (24), which serves to control the partial flows and is disposed between the lower outlet openings (**28*b*) of the flow channels (28) and the means (25**) for bringing together the partial flows of heated powder, is adapted to control the partial flows in such a manner that a predetermined outlet temperature ($T_{out}$) is attained over essentially the entire cross-section of each of the partial flows before these are brought together.

15. A device as set forth in claim 14, characterised in that the valve means (24) comprises a valve member (30) extending over the outlet openings (28*b*) of the flow channels (28) and being reciprocable transversely of the partial flows for simultaneous control thereof.

16. A device as set forth in claim 13, characterised in that the heating surfaces (27) are substantially plane-parallel, such that the powder from the storage container (10) is divided into substantially sheet-like partial flows in the flow channels (28).

17. A device as set forth in claim 13, characterised in that the heating surfaces (27) are spaced apart by 1–30 mm, preferably 5–20 mm.

18. A device as set forth in claim 13, characterised in that the heating unit (20) for heating the heating surfaces (27) comprises electric resistance-heater elements which are separate from the flow channels (28) and arranged adjacent to and distributed over the heating surfaces (27).

19. A device as set forth in claim 18, characterised in that the electric resistance-heater elements are so arranged in groups that the heating surfaces (27) are divided into a plurality of zones having different power supply, as seen in the direction of flow.

20. A device as set forth in claim 13, characterised in that the heating unit (20) for heating the heating surfaces (27) comprises a heated fluid which is separate from the flow channels (28) and flows in thermal contact with the heating surfaces (27).

21. The use of a device as set forth in claim 13 for preheating metal powder, the heated powder in the common outflow being passed to a mould where it is compacted.

* * * * *